US007698859B2

(12) United States Patent
Sansano Marti

(10) Patent No.: US 7,698,859 B2
(45) Date of Patent: Apr. 20, 2010

(54) REMOVABLE SURFACE COVERING

(75) Inventor: Vicente Sansano Marti, Onda (ES)

(73) Assignee: Vicente-Francisco Sansano Marti, Onda (Castellon) (ES)

( * ) Notice: Subject to any disclaimer, the term of this patent is extended or adjusted under 35 U.S.C. 154(b) by 0 days.

(21) Appl. No.: 11/660,506

(22) PCT Filed: Aug. 12, 2005

(86) PCT No.: PCT/ES2005/000458

§ 371 (c)(1),
(2), (4) Date: Nov. 19, 2007

(87) PCT Pub. No.: WO2006/042883

PCT Pub. Date: Apr. 27, 2006

(65) Prior Publication Data

US 2008/0118703 A1 May 22, 2008

(30) Foreign Application Priority Data

| | | |
|---|---|---|
| Aug. 20, 2004 | (ES) | 200402065 |
| Feb. 8, 2005 | (ES) | 200500247 |
| Jun. 10, 2005 | (ES) | 200501392 |

(51) Int. Cl.

| | |
|---|---|
| ***E04F 15/00*** | (2006.01) |
| ***E04F 15/22*** | (2006.01) |
| ***E04F 17/00*** | (2006.01) |
| ***E04F 13/08*** | (2006.01) |

(52) U.S. Cl. ..... 52/177; 52/302.1; 52/384; 52/390; 52/386; 52/403.1

(58) Field of Classification Search ..... 52/302.1, 52/302.3, 177, 180, 386, 390–392, 591.1–591.2, 52/592.1, 747.11, 403.1, 302.4, 664, 384, 52/389, 396.1; 404/41, 18, 31, 33, 34, 35, 404/40, 43

See application file for complete search history.

(56) References Cited

U.S. PATENT DOCUMENTS 3,438,312 A * 4/1969 Becker et al. ..... 404/40

(Continued)

FOREIGN PATENT DOCUMENTS

ES 1049016 U 10/2001

*Primary Examiner*—Richard E Chilcot, Jr.
*Assistant Examiner*—Mark R Wendell
(74) *Attorney, Agent, or Firm*—Wenderoth, Lind & Ponack L.L.P.

(57) ABSTRACT

A removable surface covering comprises a combination of lower supports with plastic support legs and upper ceramic parts which are joined to the supports by contact faces and with the aid of an adhesive material, such as to form covering modules which are interconnected using tongue-and-groove anchoring elements. The plastic supports and the ceramic parts are joined using a thick layer of adhesive which covers almost all of the contact surfaces thereof. In addition, the ceramic parts are equipped with channels and a peripheral notch which house respectively ribs and a frame belonging to the plastic support. The thickness of the adhesive extends over at least part of the thickness of the ribs and the frame of the plastic support. In another embodiment of the invention, the parts are joined at strategic points with a chemical-mechanical connection.

16 Claims, 8 Drawing Sheets

U.S. PATENT DOCUMENTS 4,590,731 A * 5/1986 DeGooyer ..... 52/581
4,648,592 A * 3/1987 Harinishi ..... 472/92
4,807,412 A * 2/1989 Frederiksen ..... 52/177
4,930,286 A * 6/1990 Kotler ..... 52/177
4,945,697 A * 8/1990 Ott et al. ..... 52/403.1
5,238,721 A * 8/1993 Nakazawa ..... 428/44
5,274,977 A * 1/1994 Bayly ..... 52/480
5,323,575 A * 6/1994 Yeh ..... 52/177
5,509,244 A * 4/1996 Bentzon ..... 52/387
5,666,772 A * 9/1997 Betty ..... 52/177
5,833,386 A * 11/1998 Rosan et al. ..... 404/36
6,129,838 A * 10/2000 Millner ..... 210/164
6,352,757 B1 * 3/2002 Kessler et al. ..... 428/120
6,467,224 B1 * 10/2002 Bertolini ..... 52/177
6,526,705 B1 * 3/2003 MacDonald ..... 52/177
6,546,687 B2 * 4/2003 Oh et al. ..... 52/409
D481,470 S * 10/2003 Moller, Jr. ..... D25/163
6,694,691 B2 * 2/2004 Ku ..... 52/403.1
6,718,714 B1 * 4/2004 Montgomery, Sr. ..... 52/392
6,802,159 B1 * 10/2004 Kotler ..... 52/177
6,918,215 B2 * 7/2005 Smith ..... 52/177
6,966,155 B2 * 11/2005 Nevison ..... 52/177
6,990,777 B2 * 1/2006 Poliacek et al. ..... 52/384
7,114,298 B2 * 10/2006 Kotler ..... 52/177
7,487,622 B2 * 2/2009 Wang ..... 52/384
7,546,715 B2 * 6/2009 Roen ..... 52/506.05
7,571,573 B2 * 8/2009 Moller, Jr. ..... 52/177
2002/0029536 A1 * 3/2002 Sala Prat ..... 52/302.1
2003/0089051 A1 * 5/2003 Bertolini ..... 52/177
2003/0177728 A1 * 9/2003 Ku ..... 52/403.1
2004/0177578 A1 * 9/2004 Casimaty ..... 52/384
2004/0216420 A1 * 11/2004 Poliacek et al. ..... 52/747.11
2004/0226233 A1 * 11/2004 LaSee ..... 52/204.5
2005/0224690 A1 * 10/2005 Hobbs ..... 249/2
2006/0260223 A1 * 11/2006 Wang ..... 52/177
2007/0039267 A1 * 2/2007 Swanson ..... 52/391
2008/0127593 A1 * 6/2008 Janesky ..... 52/581
2008/0313987 A1 * 12/2008 Ibanez et al. ..... 52/384

* cited by examiner

REMOVABLE SURFACE COVERING

FIELD OF THE INVENTION

The present invention relates to a removable surface covering applicable essentially to floors, terraces, etc., which has the feature of being easily removable and of permitting proper run-off of water and liquids that might fall onto its surface.

BACKGROUND OF THE INVENTION

There currently exist different coverings for floors, among which are those which are applied to outdoor surfaces in order to facilitate the run-off of rainwater and also in areas around swimming pools.

In some cases, the coverings include plastic parts with a hollow structure with a certain thickness which define a lower run-off chamber (S1017449).

These coverings can present problems of hygiene, and at the same time they leave a great deal to be desired at the aesthetic level.

In another case, the coverings comprise bodies manufactured from porous materials, which, although capable of draining off a certain flow of water, a certain point is reached at which saturation takes places. Also, the porosity of those bodies in some cases facilitates the proliferation of fungi and bacteria.

Also known are coverings formed from lower base parts of a plastic material and upper parts of a ceramic material, notable among which are invention patents numbers WO03/040491, EP044371, EP256189 and DE199662812.

These coverings present certain problems, for example, difficulties when it comes to exchanging ceramic parts due to breakage or for any other reason.

SUMMARY OF THE INVENTION

In order to achieve certain objectives and avoid the drawbacks mentioned in the previous section, the invention proposes a removable surface covering wherein it comprises in principle a combination of lower support elements for drainage and upper plates which are fixed on the support bodies, such that when water falls on that covering, whether it be rainwater, swimming pool water or any other, the water does not remain on the visible exterior surface but instead reaches the lower chamber formed by the support elements for drainage via some separation grooves between the plates when these are made of a ceramic or similar material.

This combination of elements provides an inhibiting covering, both for damp and for water retention due to the fact that the water, which has fallen, reaches the lower chamber formed by the support elements made essentially of plastic material.

It is also a hygienic product due to the inclusion of the upper plates which are arranged externally.

The support elements basically comprise a flat structure with passage windows or spaces containing an array of short support legs, the side edges also including means of engagement with other adjacent support elements.

When the plates are ceramic parts, they are fixed to the lower supports leaving some separation grooves therebetween so that the water can, via the grooves, reach the lower chamber corresponding to the supports, thus achieving proper run-off or flow of liquid to drain.

Another possibility could be that the ceramic parts are in contact along the entire side edges and these parts include small passage windows so that the water can reach the lower chamber.

Another possibility is that the ceramic parts include channels, the bottoms of which have a certain descending inclination towards the perimeter of the ceramic parts with the aim of encouraging the water to fall towards the separation grooves or joints between the ceramic parts and thereby facilitate the run-off of the water.

The material used for the support elements will preferably be low density polyethylene, though it can be any other.

Another characteristic of the invention is that the connection between the upper plates and the support elements includes applying an adhesive material at strategic points during the pressing of each pair of parts, in correspondence with some hollows in the support element and some slots in the upper plates, such that when the adhesive material hardens a chemical-mechanical connection is obtained.

This connection is very solid and at the same time it is possible to detach and separate the plates when necessary without interfering with the adjacent plates. The connection material adopts a structure like a rivet, so that when an upper part needs to be separated, the breakage of just the connection material corresponding to the different strategic points of that connection takes place.

This connection system economizes on sticking material and at the same time permits a certain tolerance towards movements. It also allows the ceramic part or parts to be exchanged by being vertically removed.

Another characteristic of the invention is that the visible surfaces of the ceramic parts are slightly swollen in order to improve the fall of the water towards the side edges of those parts.

In any case, the aim is for the highest point of that visible surface to be higher than the rest of the invention. To achieve this, another possibility could be for the invention to include a surface shaped like a multiple-pitch roof.

Another improvement is that the support element has a width and length slightly greater than those of the ceramic part, all this is with the aim of compensating for the minor dimensional variations which the ceramic parts can undergo during the pressing stage of manufacture.

The ceramic parts can include furrows, the ends of which lead to the edges of those parts in order to improve the drainage. The bottom of those furrows present a slight inclination, and they can also have a bottom profile shaped like a double-pitch roof.

The support elements include lateral fastenings in their edges for being able to be screwed to a lower surface corresponding to the floor, if necessary.

So, each set of support and tile comprises a covering tile module which is connected and associated with other adjacent modules by means of a tongue-and-groove coupling.

The connection between both parts of each module is done by means of tongue portions of the support which are complemented with groove portions located on the reverse side of the ceramic parts, thereby achieving a combined chemical-mechanical connection.

The plastic supports of inventive covering also comprise a structure formed from an array of coplanar ribs and a peripheral frame with a staggered configuration, the ribs being complemented with some channels located on the reverse side of the ceramic parts, so that when the adhesive is poured over the contact surface between the two component bodies of the module, the mechanical and chemical connection is made precisely via the ribs and channels with the addition of the adhesive.

The connection between the ceramic part and the plastic support is reinforced by means of a succession of small passage recesses located in an interior portion of the peripheral frame of the support, which will also receive adhesive. The reverse side of the ceramic parts in turn presents a peripheral notch corresponding to the plastic support. The adhesive layer is applied covering at least all the lower surface demarcated by the frame of the support, and the adhesive layer in turn exceeds the support ribs which remain embedded in it, achieving the desired mechanical and chemical fastening, in turn generating a reinforcing volume or lamina in the tile which stiffens it considerably, eliminating all the problems of impact resistance and also granting the unit certain thermal and sound insulating qualities that are highly advantageous for certain applications.

Moreover, in the join of the short legs with the ribs, some small tronco-conical enlargements are generated which correspond to other complementary depressions of the ceramic parts located along the channels. The ribs of the supports include other tronco-conical enlargements. In this way, a more consistent and solid mechanical connection is achieved, since these enlargements are completely embedded without the adhesive.

The short legs are also found in the peripheral frame, which includes the elements for carrying out the tongue-and-grooving between the different modules.

A provision has been made for some narrow profiles arranged in the free edges of the covering in correspondence with the different modules, in which case they serve to terminate the covering of those sides which do not end in a wall or surface that can cover them.

These narrow profiles include some anchoring extensions to the peripheral legs of the plastic supports.

These qualities make it particularly applicable to outdoor surfaces subject to rain and to swimming pool water, for example.

Provision is also made for its being laid indoors, and even, with some adaptations, for covering vertical surfaces.

Thus, the present invention is applicable in general to the following surfaces:

Outdoors for swimming pools, terraces and gardens.

Indoors for the home.

Sailing boats.

Premises for handling foods (cold storage rooms, industrial kitchens, etc.).

Pedestrian areas in ports and beaches.

Moreover, the inventive covering is not just used as a drainage system but also as a system for laying of ceramic using plastic and ceramic materials together.

An objective of the invention is to achieve a solid join between pairs of parts that are connected together via one of their faces.

Each pair of parts comprises an upper flat ceramic body and another base body with small legs for resting on the floor defining a run-off chamber for the water which falls on the covering and reaches as far as the separation channels demarcating the ceramic parts.

Another objective is to achieve a better and faster drainage of the water or liquid falling on the free surface of each ceramic part.

A further objective of the invention is to successfully compensate for small dimensional variations which ceramic parts can undergo during the manufacturing process.

Another improvement is the possibility of vertically extracting each ceramic part without the need to act on adjacent ceramic parts, which is a major advantage when exchanging parts due to breakage, or due to a desire to change one covering for another.

Another objective of the invention is the reinforcement of the actual decorative part, endowing the part with greater adherence and securing in the connection to the plastic support and, on an accessory basis, providing the assembly with improved thermal and sound insulation qualities.

Thus a covering with high resistance to impact, along with a good grip in the join between the different component parts of the covering is obtained.

Below, in order to aid a better understanding of this specification and forming an integral part thereof, some figures are attached in which, on an illustrative rather than limiting basis, the object of the invention has been represented.

DETAILED DESCRIPTION OF THE INVENTION

Figure 1:
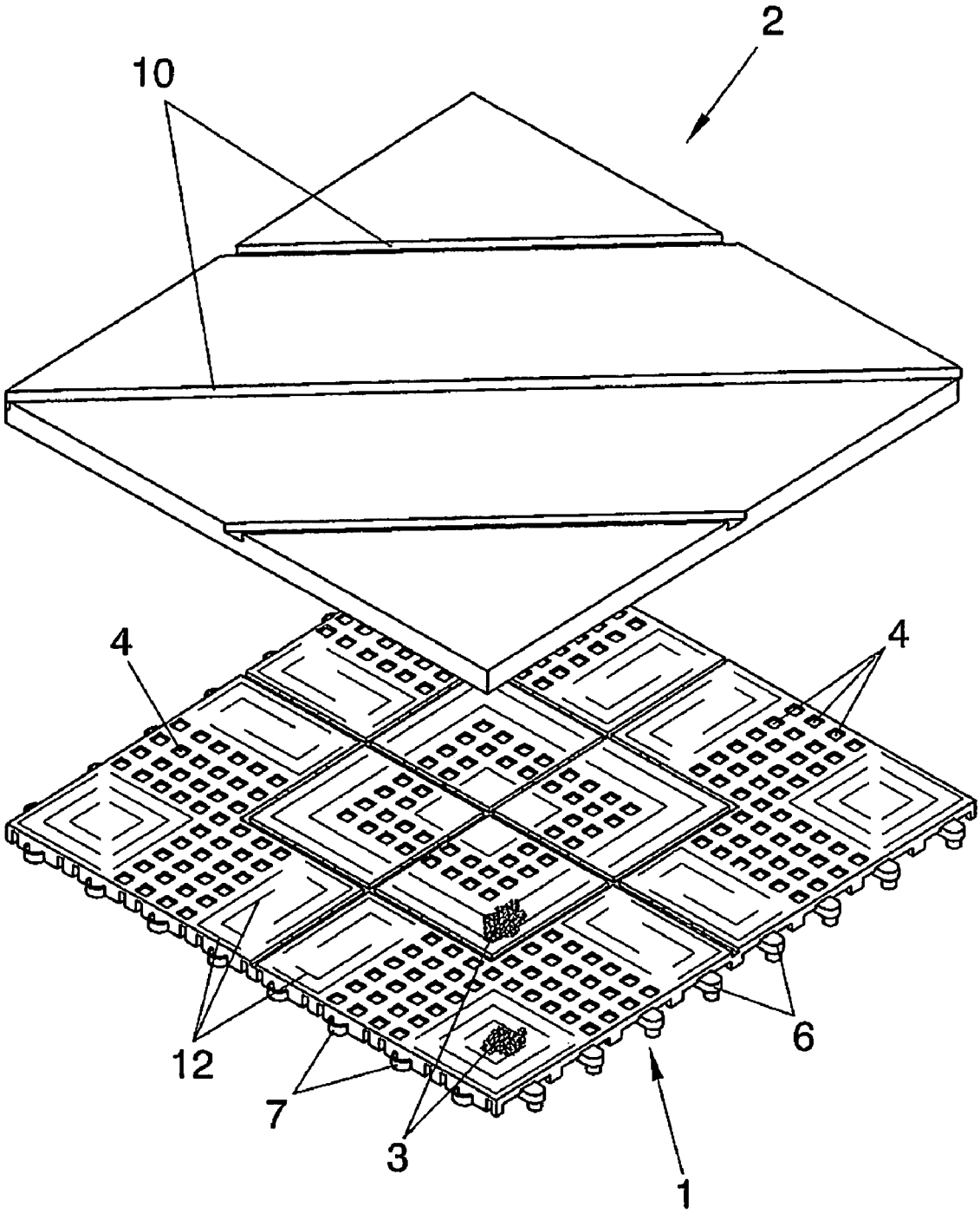
FIG. 1 shows an exploded perspective view of the removable surface covering, forming the object of the invention.
Figure 2:
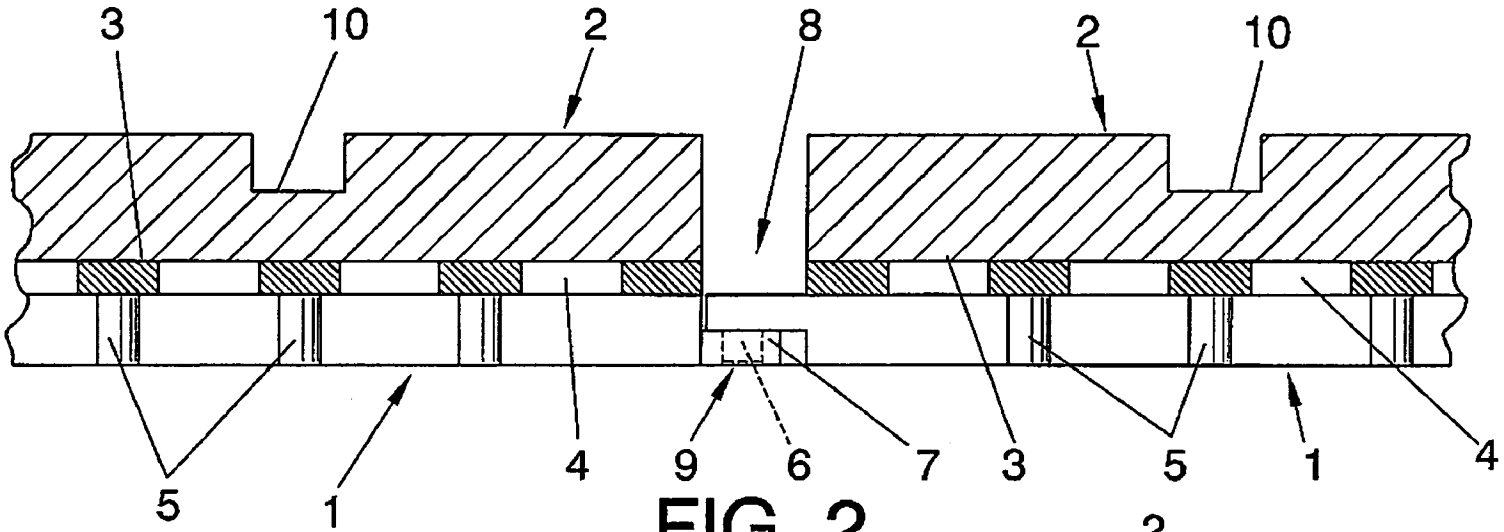
FIG. 2 shows a sectioned elevation view of the covering represented in the previous figure.
Figure 3:
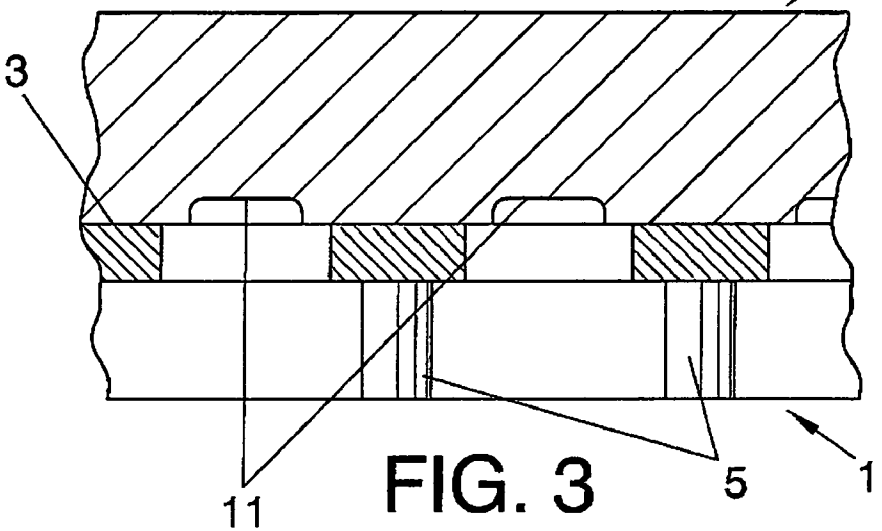
FIG. 3 shows another sectioned view of the covering of the invention.
Figure 4:
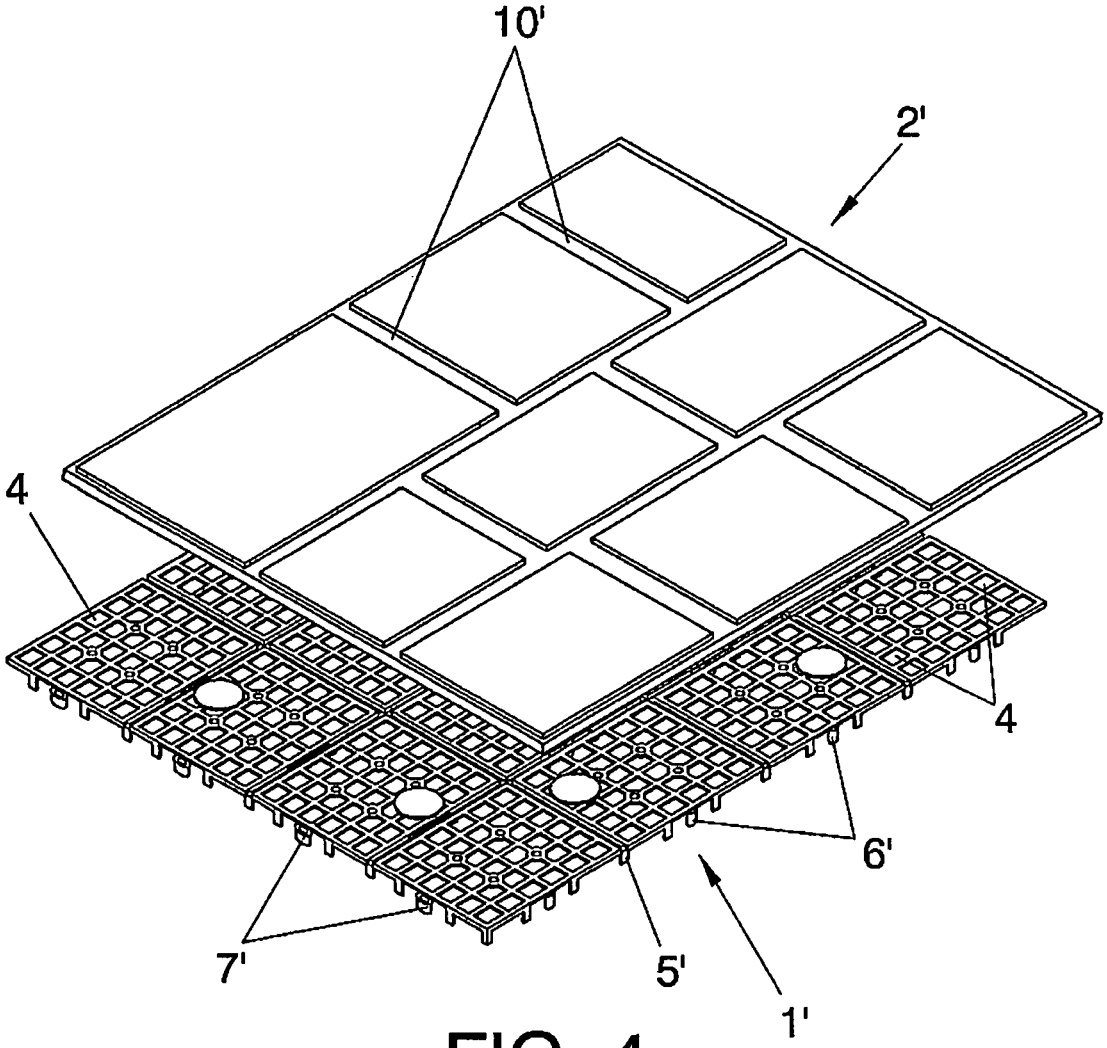
FIG. 4 shows an exploded perspective view of the removable covering with a different embodiment from that shown in the previous figures.

Considering the numbering adopted and shown in FIGS. 1-11, the removable surface covering comprises the combination of some plastic supports 1, 1', 1" and some upper ceramic supports 2, 2', 2", the two being joined via their contact faces an adhesive 3, or any other means. These plastic supports include some short legs 5, 5', 5" for resting on the ground.

In a first embodiment, the lower supports 1 include a set of passage windows 4 and also the short support legs 5 on the ground, thereby creating a run-off chamber for rainwater, swimming pool water, etc. The supports 1 also include some grooves 12.

The lower parts 1 in turn possess complementary anchoring elements 6 and 7 for associating the different lower parts 1 together.

Moreover, the edges of the upper parts 2 coincide with the edges of the lower supports 1, such that between the upper parts 2 some separation channels 8 are created which coincide with other separation channels 9 existing between the lower parts, these latter channels 9 being where the anchoring elements 6 and 7 between the different lower parts 1 are to be found.

Thus, the water, which falls on the ceramic parts 2, will reach as far as the run-off chamber precisely via the peripheral channels demarcating and separating the different parts.

In addition, the ceramic parts 2 can include some furrows 10, which lead to the peripheral channels, and at the same time these furrows possess a gentle and slight inclination descending towards the edges of the ceramic parts 2.

Moreover, the lower face of the ceramic parts 2 can include depressions 11 which will be complemented with projections of the plastic supports 1 for improving the resistance to movement between the parts, as well as the connection and immobilization of the parts.

The distribution of the short support legs 5 of the lower supports 1 permit the load to be borne by the covering to be distributed, such that removable surface can be transited by vehicles.

In a second embodiment, the adhesive material 3 is located in correspondence with slots 13 of the ceramic parts 2' and in correspondence with facing hollows of the lower parts 1'.

Figure 5:
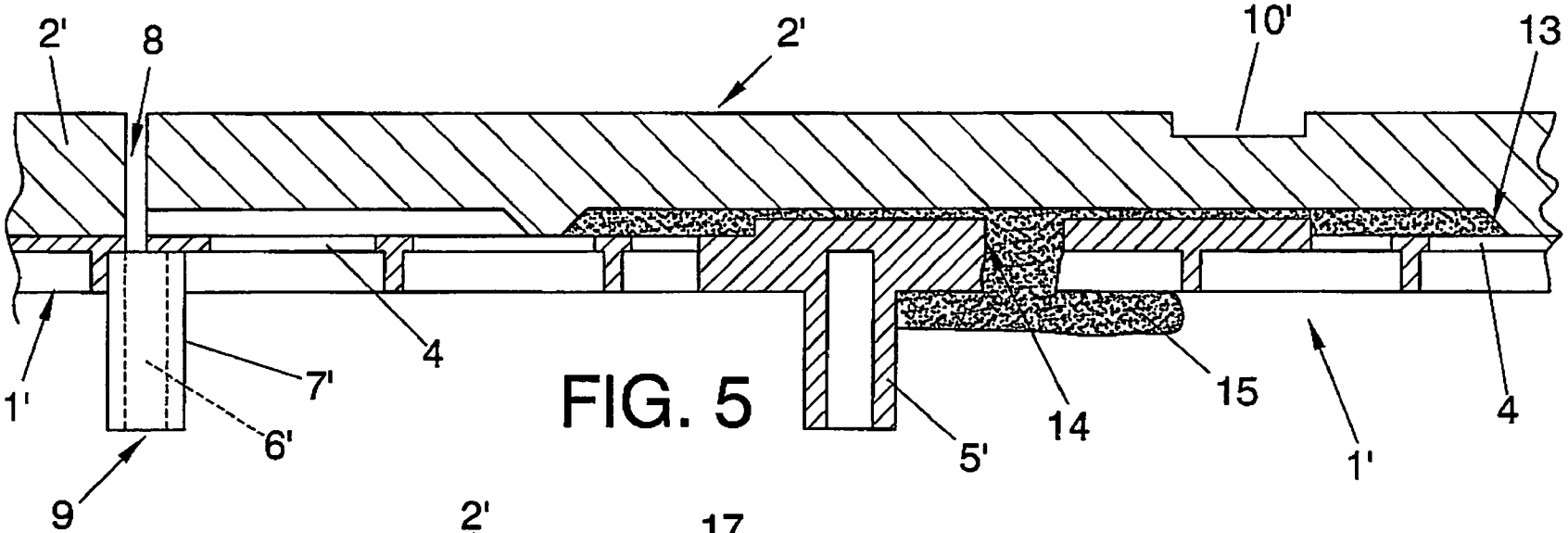
FIG. 5 shows a sectioned view of that represented in the previous figure.

As shown in FIG. 5, the hollows include passage openings 14, such that, when the two parts are pressed together, in order to proceed to their joining, the adhesive material, still soft, will adopt a structure in the form of a mushroom 15 by way of a rivet, such that when the adhesive dries, a chemical and mechanical connection will be obtained via the different points where the adhesive has been applied.

Figure 6:
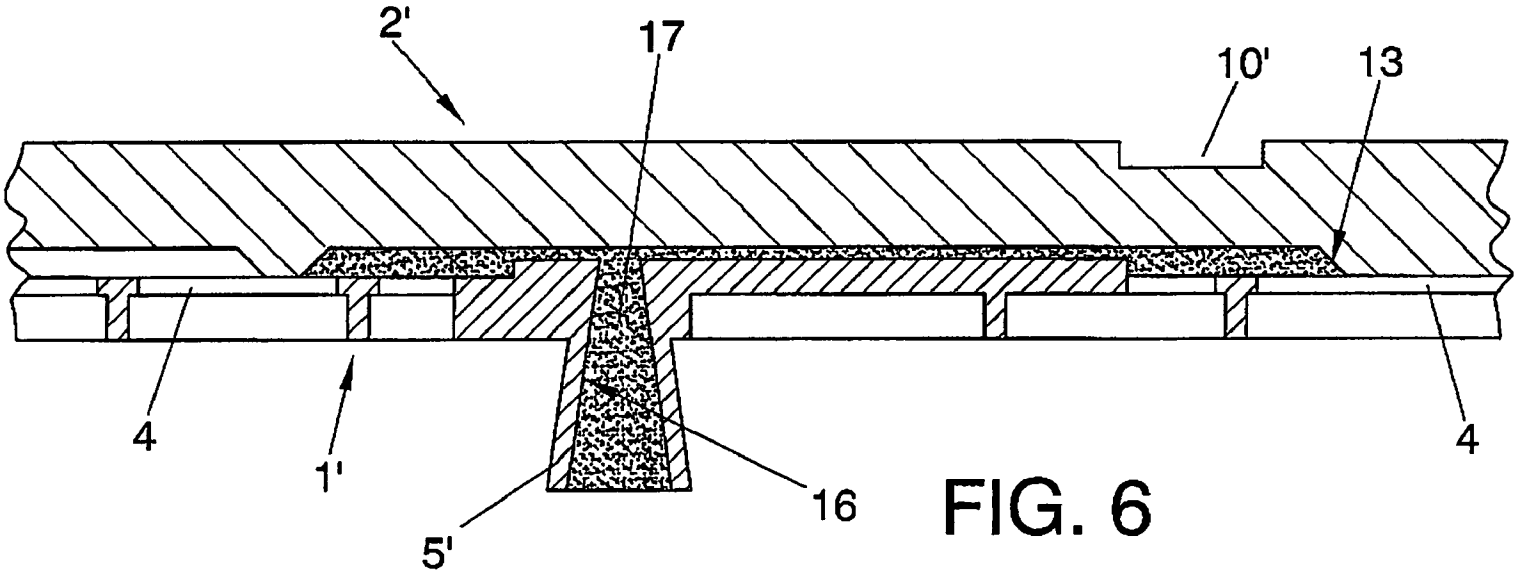
FIG. 6 shows another sectioned view of the covering shown in FIG. 4.
Figure 7:
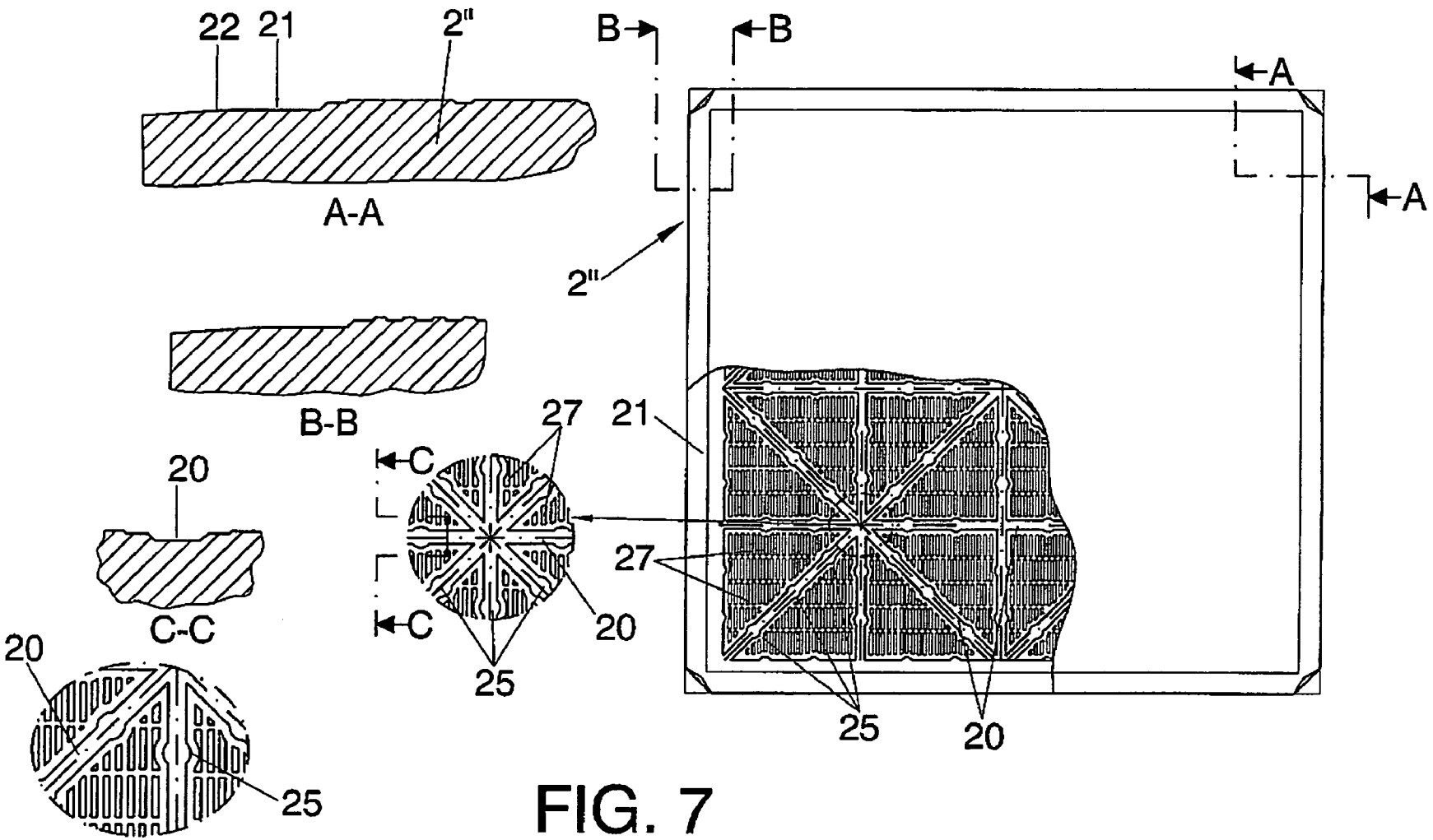
FIG. 7 shows a plan view of the reverse side of a ceramic part which forms part of the removable surface covering. In this embodiment, the covering basically comprises a base support with short support legs and a ceramic part which is joined to the base support by means of an adhesive layer.
Figure 8:
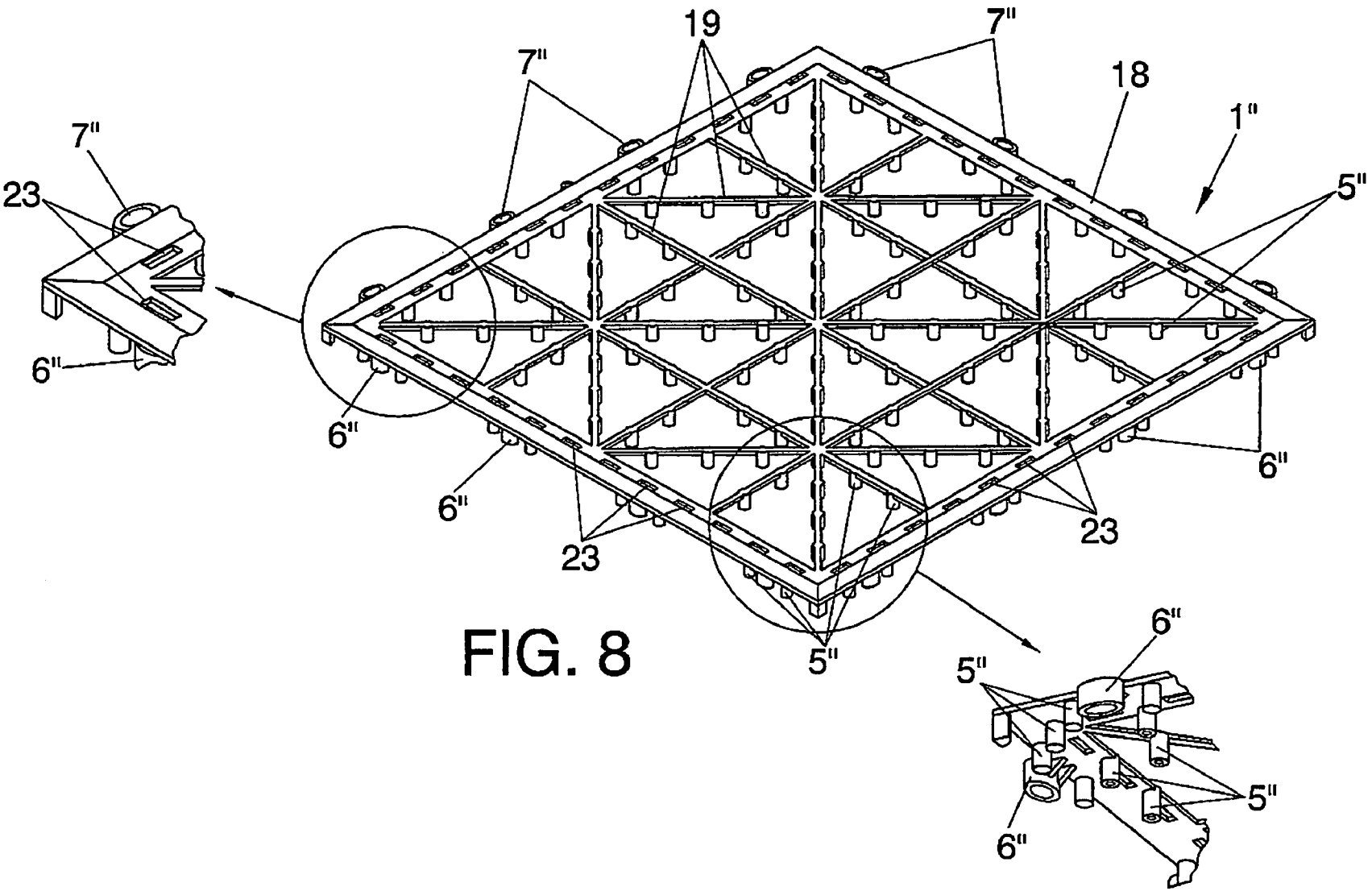
FIG. 8 shows a perspective view of a plastic support which forms part of the covering shown in the previous figure.
Figure 9:
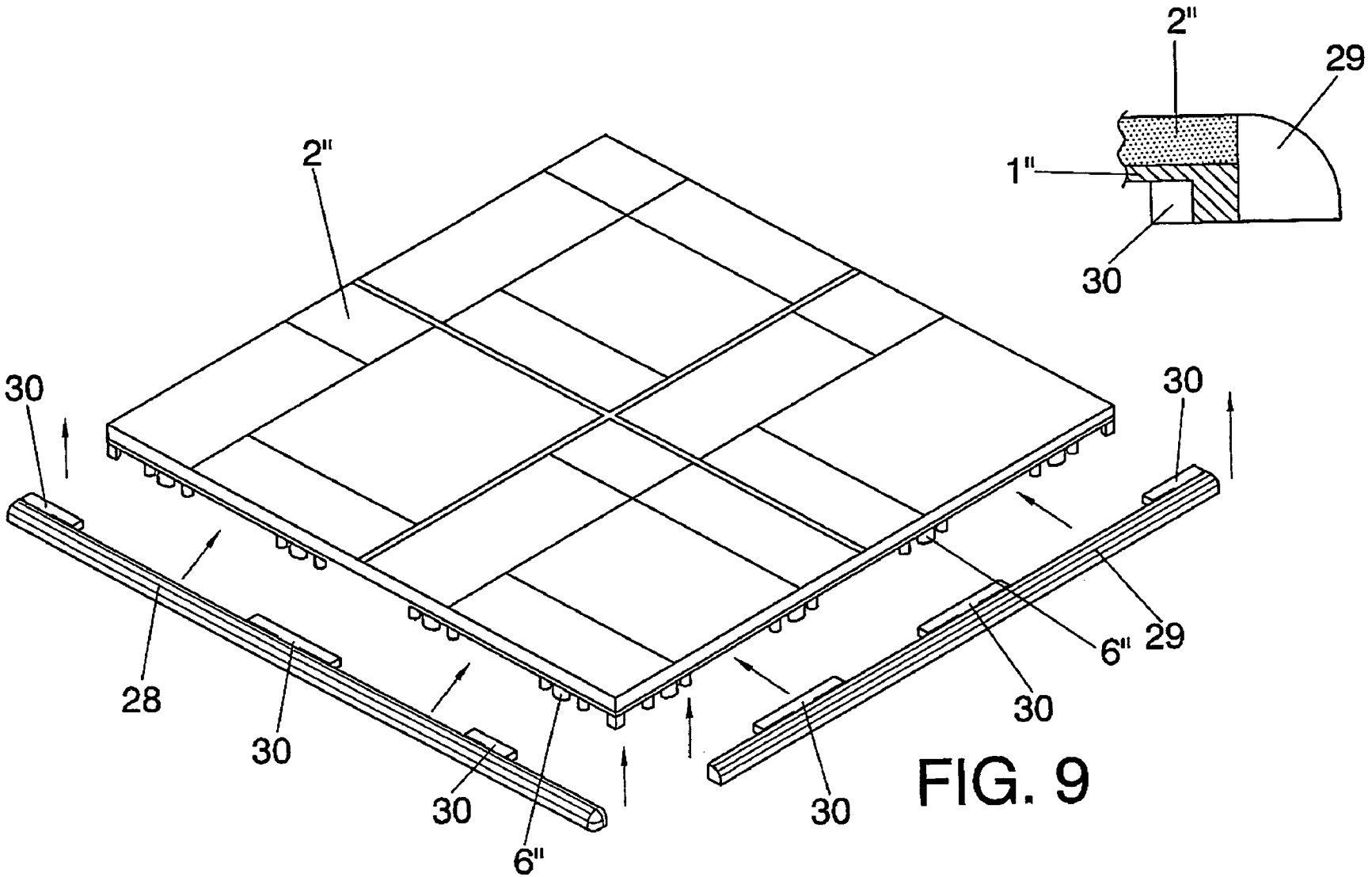
FIG. 9 shows a perspective view of the unit of a ceramic part and plastic support with the inclusion of some narrow terminal profiles for decoration and finishing.
Figure 10:
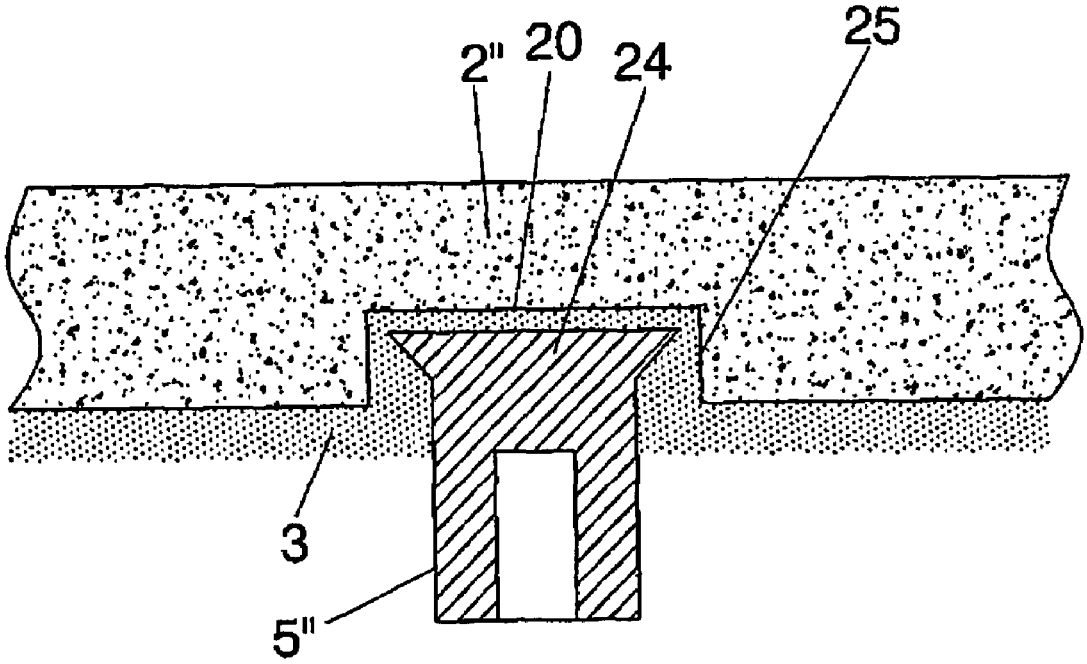
FIGS. 10 and 11 represent respective sectioned details essentially showing the connection of the ceramic part and plastic support by means of the corresponding adhesive.
Figure 11:
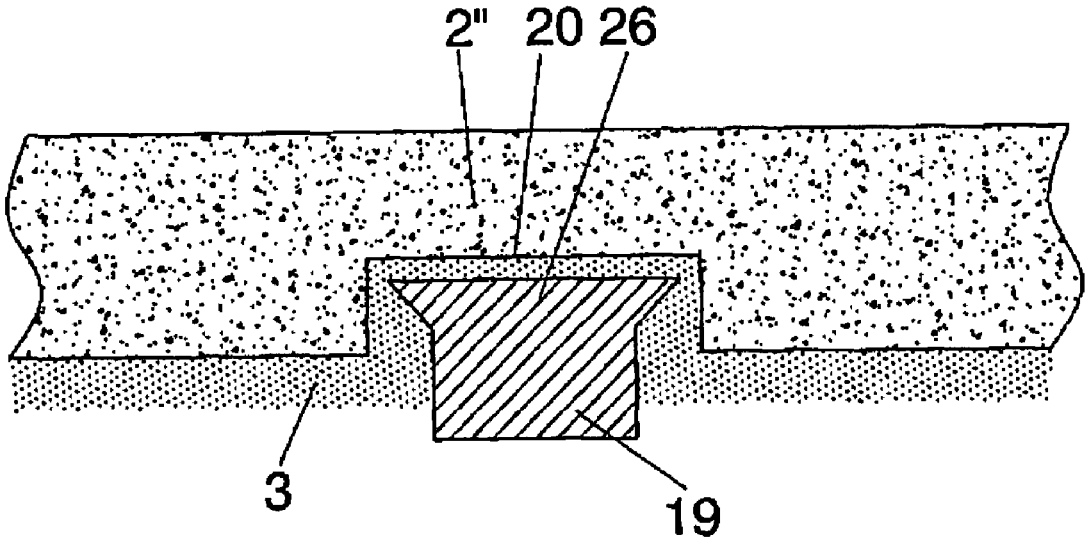

As shown in FIG. 6, the hollows consist of some conical shaped openings 16, such that when the adhesive dries a solid fastening with a rivet structure 17 is obtained.

The lower supports 1' include the set of passage windows 4, along with the short support legs 5' on the ground, thereby creating a run-off chamber for rainwater, swimming pool water, etc., as occurred in the first embodiment.

The lower parts 1' in turn possess complementary anchoring elements 6' and 7' for associating the different lower parts 1' together.

Moreover, the edges of the upper parts 2' are in correspondence with the edges of the lower supports 1', such that, as occurred in the first embodiment, between the upper parts 2' some separation channels 8 are created which coincide with other separation channels 9 existing between the lower parts, these latter channels 9 being where the anchoring elements 6' and 7' between the different lower parts 1' are to be found.

Thus, the water which falls on the ceramic parts 2' will reach as far as the run-off chamber precisely via the peripheral channels demarcating and separating the different parts.

In addition, the ceramic parts 2' can include some furrows 10', which lead to the peripheral channels, and at the same time those furrows possess a gentle and slight inclination, either descending towards the edges of the ceramic parts 2' or pairs of descending planes like a double-pitch roof.

The distribution of the short support legs 5' of the lower supports 1' permit the load to be borne by the covering to be distributed, such that the removable surface covering can be transited by vehicles.

The decorative free surface of the ceramic parts 2' is higher in the middle in order to facilitate the drainage of water. It can be a swollen surface, a surface shaped like a quadruple-pitch roof or similar.

The plastic support 1' includes, in at least one of its sides, a projecting opening which exceeds the perimeter of the ceramic part (similar to the anchorings) for the use of mechanical fastenings to couple to the floor or the wall. This permits the covering to be secured in zones where it could slip if it is simply held in position with the fastenings offered by the supports.

In a third embodiment (FIGS. 7, 8, 9, 10 and 11) the removable covering comprises plastic supports 1" and some upper parts of a ceramic nature 2", which are connected via their contact faces a thick layer of adhesive 3 which will cover virtually the entire contact surface of both parts, constituting covering modules which will be linked by a tongue-and-groove connection made up of small tongue 6" and groove 7" anchoring elements integral with the plastic supports 1".

The plastic support 1" includes a staggered peripheral frame 18 and a cross-linkage of ribs 19 which are located in correspondence with a complementary cross-linkage of channels 20 located on the reverse side of the respective ceramic part 2".

In turn, the peripheral frame 18 of the plastic support 1" is located in correspondence with a peripheral notch 21 of the reverse side of the respective ceramic part 2", notch 21 possessing a gentle exterior inclined plane 22.

This peripheral zone also receives the adhesive 3, with part of the fastening being assured by a succession of small recesses 23 made in the interior portion of that frame 18 of the plastic support 1".

The plastic support 1" includes an array of small support legs 5" integral with the ribs 19 and also with the peripheral frame 18.

In the confluence of the legs 5" with the different ribs 19, some tronco-conical enlargements 24 are generated which are located in some complementary depressions 25 established along the channels 20 of the reverse side of the ceramic part 2".

The ribs 19 of the plastic supports 1" present in their upper part a configuration with an inverted trapezoid section 26 which, added to the tronco-conical enlargements 24, creates a stronger, more flexible and solid mechanical join, along with greater robustness and rigidity in each covering module comprising a ceramic part and plastic support.

The areas of the reverse side bounded by the channels 20 and peripheral notch 21 comprise a multitude of tronco-pyramidal prominences with rectangular bases 27 which also help to provide better fastening between the plastic support and the respective ceramic part.

Moreover, some narrow decorative profiles 28 and 29 are provided, with circular section, which serve to finish the free sides of the covering.

These profiles 28 and 29 possess some T-shaped extensions 30 in one of their faces in order to facilitate their securing to the plastic support 1" in correspondence with some of the short legs 5" emerging from the peripheral frame 18 of that support 1".

The invention claimed is:

1. A removable surface covering, comprising:

a lower section including a plurality of lower parts formed from a plastic material, short legs for resting on the ground, a draining chamber having an inner space and being disposed between the legs, anchoring elements configured to anchor adjacent lower parts with a tongue and groove configuration, and a lower separation channel having an inner space and being disposed between edges of adjacent lower parts, the inner space of the lower separation channel being connected to the inner space of the draining chamber; and an upper section including a plurality of upper parts formed from ceramic material, each upper part being connected to a lower part, and an upper separation channel having an inner space and being disposed between edges of adjacent upper parts, the inner space of the upper separation channel being connected to the inner space of the lower separation channel;

wherein the draining chamber is opened to the outside via the lower and upper separation channels.

2. A removable surface covering, according to claim 1, wherein faces of the upper and lower parts in contact have complementary tongue-and-groove elements for fastening the upper and lower parts.

3. A removable surface covering, according to claim 1, wherein an outside surface of the upper section includes a plurality of furrows with a descending inclination towards the edges of the upper section and corresponding with the upper and lower separation channels.

4. A removable surface covering, according to claim 1, wherein the lower parts include a set of passage windows and a plurality of grooves.

5. A removable surface covering, according to claim 1, further including adhesive material joining the upper and lower sections and being disposed on an area of the upper parts where a plurality of slots are disposed, the plurality of slots facing a plurality of hollows in the lower parts, such that when the upper and lower sections are pressed together for joining, the adhesive material, when soft, forms a rivet structure having a chemical connection and a mechanical connection.

6. A removable surface covering, according to claim 5, wherein the hollows of the lower parts include a plurality of passage openings, and the adhesive material has a rivet structure configured as a double mushroom, one part of the double mushroom corresponding to the slots of the upper parts and the other part of the double mushroom corresponding to a portion located in correspondence with a contact surface of the lower parts.

7. A removable surface covering, according to claim 5, wherein the hollows of the lower parts include a plurality of conical shaped openings.

8. A removable surface covering, according to claim 1, wherein the upper section has an outside surface, the outside surface of the upper section being higher in the middle of the upper section than at the edges of the upper section to facilitate the drainage and fall of water.

9. A removable surface covering, according to claim 8, wherein the outside surface of the upper section has a swelling shape.

10. A removable surface covering, according to claim 8, wherein the outside surface of the upper section includes a plurality of planes inclined downwardly toward the edge of the upper section.

11. A removable surface covering, according to claim 10, wherein the lower section comprises a staggered frame and an array of ribs disposed in a plurality of channels on an inner surface of the upper section, the frame being located so as to correspond with a peripheral notch of the inner surface of the upper section, the adhesive material being applied to the entire contact surface of the upper and lower sections with the adhesive material having a thickness that covers at least part of the thickness of the frame and ribs of the lower section.

12. A removable surface covering, according to claim 11, wherein the ribs of the lower section include an upper face having an inverted trapezoid section embedded in the adhesive material.

13. A removable surface covering, according to claim 11, wherein the short legs adjacent the ribs are joined to the ribs and shape at least two inverted tronco-conical portions embedded in the adhesive material, the at least two tronco-conical portions fitting in a plurality of complementary depressions disposed along the channels of the inner surface of the upper section.

14. A removable surface covering, according to claim 11, wherein the staggered frame includes a succession of recesses embedded in the adhesive material.

15. A removable surface covering, according to claim 11, wherein a plurality of narrow decorative profiles are fixed in a plurality of legs disposed adjacent the edges of the upper section and integral with the staggered frame so as to cover and decorate the free edges of the covering.

16. A removable surface covering, according to claim 15, wherein the narrow decorative profiles include a plurality of T-shaped extensions configured to fasten to the legs of the lower parts.

* * * * *